US008322578B2

(12) United States Patent
Janssen et al.

(10) Patent No.: US 8,322,578 B2
(45) Date of Patent: Dec. 4, 2012

(54) ONE-WAY VALVE FOR DELIVERING A FREE-FLOWING MATERIAL

(75) Inventors: Frank Janssen, Garmisch-Partenkirchen (DE); Roland Kneer, Farchant (DE)

(73) Assignee: Gaplast GmbH, Altenau (DE)

( * ) Notice: Subject to any disclaimer, the term of this patent is extended or adjusted under 35 U.S.C. 154(b) by 1282 days.

(21) Appl. No.: 10/511,928

(22) PCT Filed: Apr. 4, 2003

(86) PCT No.: PCT/DE03/01108
§ 371 (c)(1),
(2), (4) Date: Apr. 28, 2005

(87) PCT Pub. No.: WO03/089325
PCT Pub. Date: Oct. 30, 2003

(65) Prior Publication Data

US 2005/0224520 A1 Oct. 13, 2005

(30) Foreign Application Priority Data

Apr. 19, 2002 (DE) ..... 102 17 655

(51) Int. Cl.
*B65D 25/40* (2006.01)
*B65D 33/38* (2006.01)
*B65D 5/72* (2006.01)

(52) U.S. Cl. ..... 222/493; 222/494; 222/190; 222/212; 210/649

(58) Field of Classification Search ..... 222/189.11, 222/190, 212, 213, 492, 493, 494; 210/649, 210/650, 651, 653
See application file for complete search history.

(56) References Cited

U.S. PATENT DOCUMENTS 2,016,037 A * 10/1935 Gruber ..... 222/493
(Continued)

FOREIGN PATENT DOCUMENTS

GB 1583494 1/1981

OTHER PUBLICATIONS

PCT/DE03/01108 PCT International Examination Report.

(Continued)

*Primary Examiner* — Kevin P. Shaver
*Assistant Examiner* — Melvin Cartagena
(74) *Attorney, Agent, or Firm* — Greer, Burns & Crain, Ltd.

(57) ABSTRACT

A one-way valve for the recontamination-protected repeated discharge of a flowable material from a container of a preferably reducible volume contains a valve seat which consists of a rigid plastic material and which is arranged in the container neck and comprises a base body which rests on the inner wall of the container neck and contains at least one through hole, and a projection which extends in axial direction of the container neck towards the exit opening. The valve seat has arranged thereabove an elastic seal which comprises an annular section covering the at least one through hole, and a sleeve-like section which surrounds the projection at a radial distance with the exception of its end section which in the closed state of the one-way valve rests in the exit opening on the end section of the projection. A sterilization element of silver or of another metal having an oligodynamic action may be arranged in the intermediate space between the projection of the valve seat and the elastic seal. The application of pressure to the contents of the container has the effect that the annular section of the seal releases the at least one through hole of the valve seat, the end section of the sleeve-like part of the seal exiting from the exit opening and releasing the same. The seal will then return into the initial state. The contents of the container is safely sealed against the ingress of contaminants.

16 Claims, 4 Drawing Sheets

U.S. PATENT DOCUMENTS

| | | | | | |
|---|---|---|---|---|---|
| 2,628,004 | A | * | 2/1953 | Schlicksupp | 222/493 |
| 4,739,906 | A | * | 4/1988 | LoTurco | 222/212 |
| 5,025,957 | A | | 6/1991 | Ranalletta et al. | |
| 5,226,568 | A | * | 7/1993 | Newton et al. | 222/212 |
| 5,255,826 | A | * | 10/1993 | Ranalletta et al. | 222/493 |
| 5,360,145 | A | * | 11/1994 | Gueret | 222/190 |
| 5,490,938 | A | * | 2/1996 | Sawan et al. | 210/651 |
| 6,616,012 | B2 | * | 9/2003 | Dark | 222/1 |
| 6,824,015 | B1 | * | 11/2004 | Ammann | 222/108 |

OTHER PUBLICATIONS

PCT/DE03/01108 PCT International Search Report.

* cited by examiner valve closed valve opened

ONE-WAY VALVE FOR DELIVERING A FREE-FLOWING MATERIAL

FIELD OF THE INVENTION

The present invention relates to a one-way valve for discharging a flowable material from a container of a preferably reducible volume, comprising a cap which is seated on the container neck and has an exit opening for the material.

BACKGROUND OF THE INVENTION

Containers having a reducible volume may e.g. be a rigid outer container with an inner container or inner pouch consisting of a soft material, which after part of the flowable material has been discharged contracts each time accordingly, with pressure compensating openings being provided in the outer container for pressure compensation between the rigid outer container and the inner container. The container, however, may also be single-walled and e.g. have the shape of a tube which is gradually compressed for discharging the material. As further examples of a container having a reducible volume, reference is herewith made to bellows-type containers which gradually collapse in proportion to the discharge of the flowable material, and to syringes whose volume can be reduced by advancing a syringe plunger. It goes without saying that the above enumeration is only by way of example.

The container, however, need not be of a reducible volume. Compensation may also be achieved through inflowing air flowing through a filter (sterile filter).

The flowable material may be a liquid, or it may be a cream, gel, ointment, or another substance, optionally of a high viscosity.

The one-way valve of the above-considered type is meant to discharge the flowable contents of the container in individual partial amounts or doses and, depending on the application, the flowable contents may be discharged in doses, distributed over a prolonged period of time.

When many types of flowable materials are discharged, it is important that the material remaining in the container should not be impaired by the ingress of foreign matter, be it microorganisms or inorganic or organic impurities. Above all in pharmaceutical, but also e.g. in cosmetic flowable materials, this determines the quality, but is e.g. also applicable to substances to be counted among foodstuff. That is why the material volume discharged from the container must not be compensated by air entering into the container if a situation is to be prevented where bacteria, dust, moisture, etc. get into contact with the remaining contents of the container. That is why, as has been mentioned above, the volume must be reduced in the container in question in proportion to the amount of material discharged. It must above all be ensured that no microorganisms penetrate through the container opening and contaminate the remaining contents of the container.

SUMMARY OF THE INVENTION

It is the object of the present invention to indicate a one-way valve of the type in question in which the sterility of the flowable material remaining in the container is substantially guaranteed.

This object is achieved according to the invention by a one-way valve for discharging a flowable material from a container of a reducible volume, comprising a cap which is seated on the container neck and includes an exit opening for the material, comprising a valve seat which is arranged in the container neck and comprises a base body which rests on an inner wall of the container neck and contains at least one through hole, and a projection which extends in an axial direction of the container neck towards the exit opening, and an elastic seal which comprises an annular section which covers the at least one through hole, and a sleeve-like section which surrounds the projection at a radial distance with the exception of its end section which in the closed state of the one-way valve rests in the exit opening on the end section of the projection.

Further advantageous features of the invention are described below.

The one-way valve according to the invention contains a valve seat which consists of a rigid plastic material such as PE/PP and is arranged in the container neck.

When the container has, for instance, a continuous tubular shape, the valve seat is inserted in the end section of the container.

The valve seat contains a basic body which rests on the inner wall of the container neck and comprises at least one through hole that when released allows for the passage of the flowable material towards the exit opening of the container. Furthermore, the valve seat has a projection which is connected to the basic body and which extends in axial direction of the container neck towards the exit opening of the container.

Furthermore, the one-way valve according to the invention comprises an elastic seal which comprises an annular. section which covers the at least one through hole and has a sleeve-like section which is integrally formed therewith and which surrounds the projection, which is preferably arranged in the center in the container neck, at a radial distance with the exception of the end section of the sleeve-like part which in the closed state of the valve preferably rests inside the exit opening of the container on the end section of the projection. The annular section of the elastic seal is here pressed radially outside of the at least one through hole of the valve seat against the valve seat.

Moreover, the one-way valve preferably contains a sterilization means which is arranged in the intermediate space between the projection of the valve seat and the sleeve-like section of the elastic seal, and exerts a bactericidal effect on bacteria that have possibly penetrated, etc.

The sterilization means may be a preferably spiral-like sterilization element which surrounds the projection, or it may be formed by coating at least parts of the valve seat and/or the seal with the oligodynamically active material or the bactericidal substances.

In the one-way valve of the invention, the valve seat closes the container neck, except for its at least one through hole, or if such a neck is not formed, the cross-section of the container positioned in front of the exit opening. In the closed state of the valve, the elastic seal firmly rests on the base body of the valve seat because it is preferably held with its annular outer portion in contact with the valve seat, preferably pressed by an annular projection of the cap of the container against the valve seat. The elastic seal which lies flat on the base body of the valve seat thereby closes the at least one through hole of the valve seat.

Furthermore, the elastic seal rests with the end section of its sleeve-like section tightly on the head end of the preferably pin-shaped projection, namely inside the exit opening of the container in such a way that said exit opening in the closed state of the valve is tightly closed. Due to the tight contact with the pin- or peg-shaped projection of the valve seat it is also ensured that no impurities can penetrate from the outside between the projection and the sleeve-like section of the seal.

When pressure is exerted on the contents of the container, preferably by applying an external force to the container, the flowable material is pressed through the at least one through hole of the valve seat against the annular section of the elastic seal positioned thereabove, whereby said seal is lifted from the base body of the valve seat. This has the consequence at the same time that the end section of the sleeve-like section of the elastic seal is lifted from the end section of the projection of the valve seat, i.e. it is moved in axial direction of the container neck and preferably projects from the exit opening of the container. The flow path through the exit opening of the container is thereby released for the flowable material which has passed through the at least one through hole of the valve seat.

When pressure is no longer exerted on the contents of the container, the seal will return due to its elasticity into its initial position in which the at least one through hole of the valve seat and the exit opening of the container are closed.

Even if microorganisms enter into the space between the elastic seal and the valve seat through the opening area of the container, the sterilization element arranged there would efficiently prevent a harmful propagation of microorganisms, so that the sterility of the container contents is ensured. This is true for both the flowable material remaining between the seal and the valve seat, and the contents of the container remaining below the one-way valve.

The flowable material can be discharged not only by exerting pressure on the contents of the container, but also by exerting a negative pressure from the outside on the elastic seal and, after the same has been opened, on the contents of the container.

It is suggested in further details that the base body of the valve seat should be equipped, radially outside the projection, with a plurality of through holes that should be evenly distributed over the circumference. To this end the through holes may have the shape of slots formed in the manner of a circular arc.

Preferably, it is intended that the base body of the valve seat comprises a planar base plate through which the at least one through hole extends, and a circumferential wall adjoining the inner wall of the container neck, which rests with an outwardly surrounding annular shoulder on the edge of the container neck. Like the container neck, the circumferential wall has in general a circular cylindrical shape. The cap of the container rests on the upper edge of the circumferential wall of the valve seat, whereby the valve seat is fixed.

The cap may be a screw cap. However, the cap may e.g. also be snapped onto the container neck.

The projection which is preferably attached in the center on the planar base plate of the valve seat has in general the form of a pin or peg and may be designed such that it has the shape of a circular cylinder with a preferably conically tapering end section.

Alternatively, the projection may have an arcuate contour in longitudinal section; other shapes are also possible as long as the end section of the projection provides for an appropriate sealing surface for the sleeve-like section of the elastic seal.

Advantageously, the upper edge of the projection of the valve seat is arranged inside the container opening, the edge being in alignment with the upper side of the cap. It goes without saying that the diameter of the end section of the projection is smaller than the diameter of the container opening because the end section of the sleeve-like section of the elastic seal is arranged in the annular intermediate space.

The annular section of the elastic seal has preferably also a planar shape and is held in the area of its circumferential edge in contact with the planar base plate of the valve seat. Preferably, the closing cap of the container has an annular projection which presses the elastic seal in the above-indicated area against the valve seat. The annular section of the seal may also be held by other means on the valve seat, e.g. by gluing.

The sleeve-like section which adjoins the annular section of the seal and which is also formed in the center may first be configured to be circular and cylindrical in longitudinal section, starting from the annular section, and then to be conical. In an alternative form, the sleeve-like section has an arcuate contour in longitudinal section.

The end section of the sleeve-like part of the elastic seal has an inner contour corresponding to the circumferential surface of the head section of the projection and rests with the exterior surface on the wall of the container opening, the wall cross-section of the end section of the sleeve-like part having substantially the form of a wedge. Said section which, when viewed in cross-section, expands substantially in the form of a wedge towards the end closes the annular gap between the head section of the projection of the valve seat and the inner wall of the container opening in the closed state of the valve, the cross-sectional shape promoting the tight closure due to the restoring force of the elastic sealing material.

A tight closure may also be ensured in addition by manually pressing back the end section of the sleeve-like part of the seal if the seal does not return automatically into the entirely closed state, which may possibly be the case with highly viscous materials.

The sterilization element which is arranged in the intermediate space (dead volume) between the seal and the valve seat surrounds the projection of the valve seat preferably in a spiral form. The dimensions are expediently chosen such that the sterilization element which may have the shape of a helical spring is, on the upper end portion of the projection, in contact with both said end portion and the sleeve-like section of the seal, so that microorganisms possibly entering into the exit opening of the container are bound to get into contact with the sterilization element if they migrate downwards. Microbial contamination is safely prevented thereby.

The sterilization element consists of silver or contains a silver coating which develops a sterilizing effect. Instead of silver, it is also possible to use other metals having an oligodynamic action, or bactericidal substances.

BRIEF DESCRIPTION OF THE DRAWINGS

Further details of the invention become apparent from the following description of a preferred embodiment and from the drawing, in which.

DETAILED DESCRIPTION OF PREFERRED EMBODIMENTS

Figure 1:
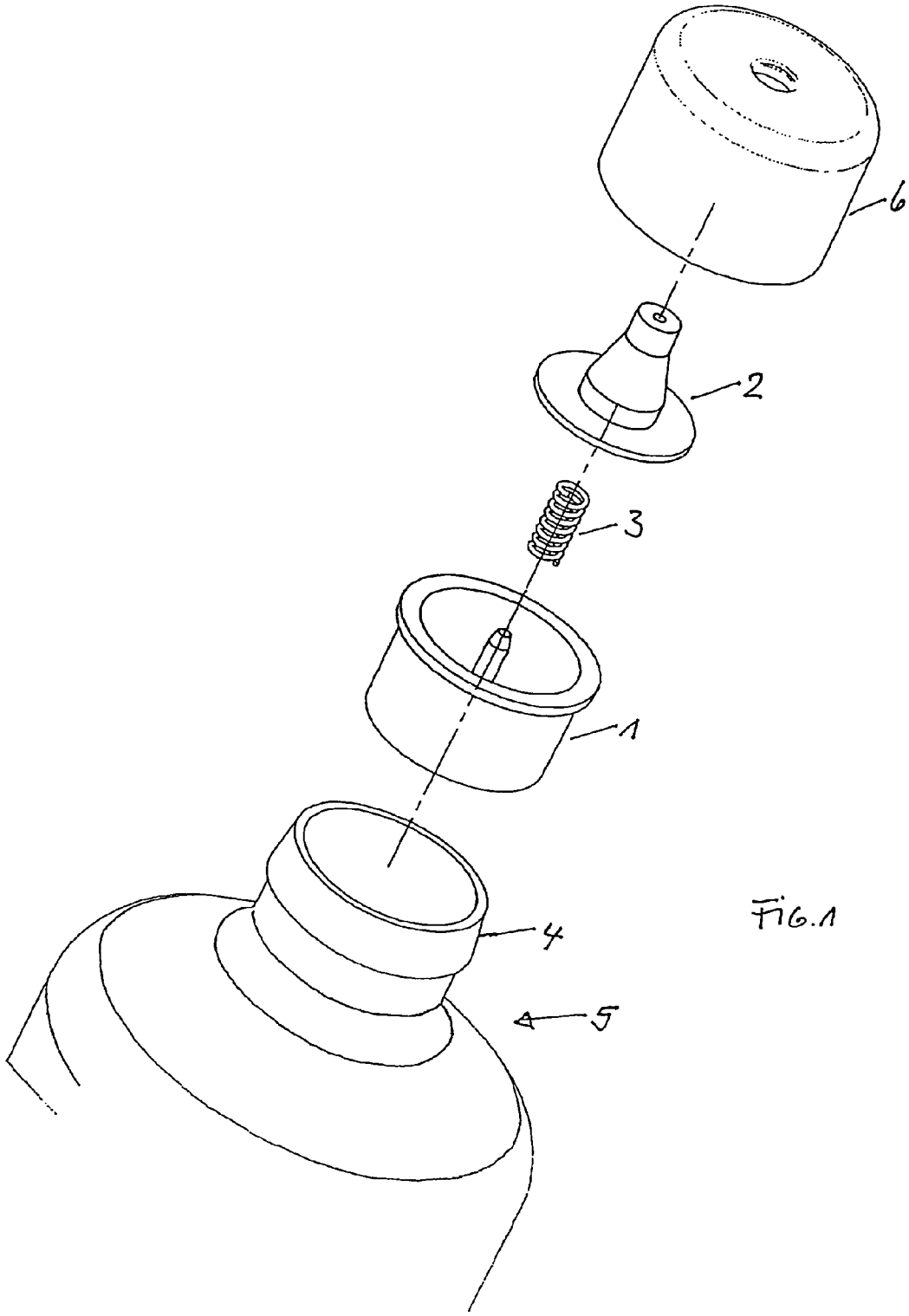
FIG. 1 shows an exploded view of the components of an embodiment of the one-way valve of the invention with associated container neck and container cap.
Figure 2A:
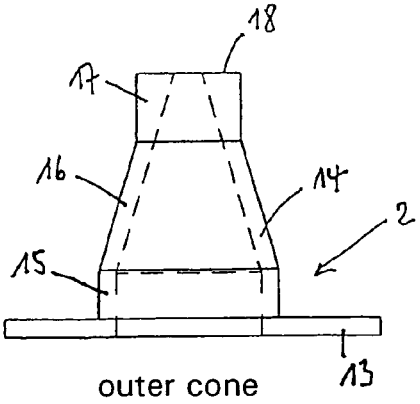
FIGS. 2A and 2B show a side view and a top view of the valve body according to FIG. 1.
Figure 2B:
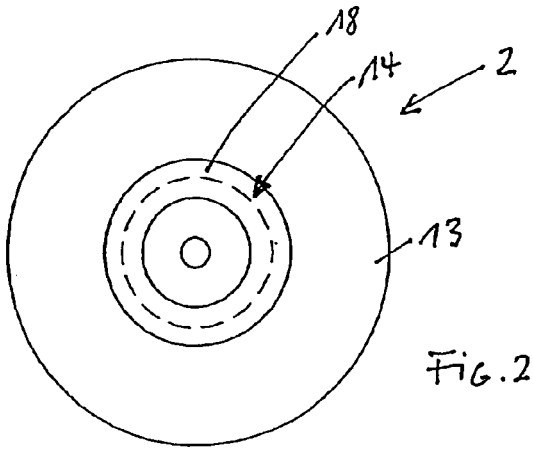
Figure 3A:
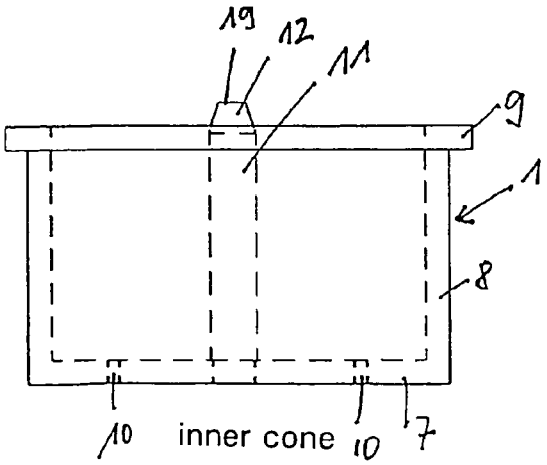
FIGS. 3A and 3B show a side view and a top view of the valve seat according to FIG. 1.
Figure 3B:
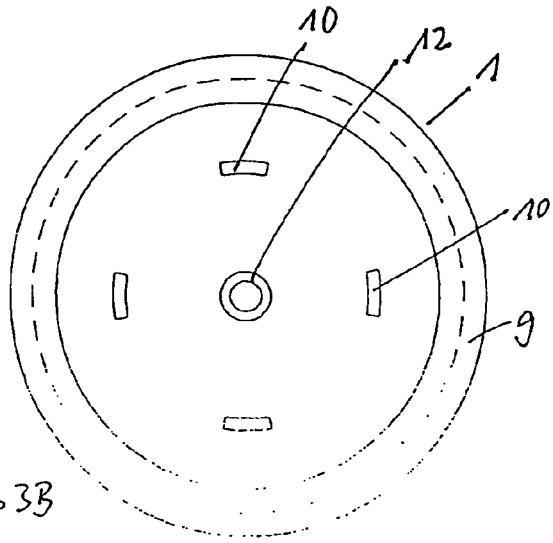
Figure 4A:
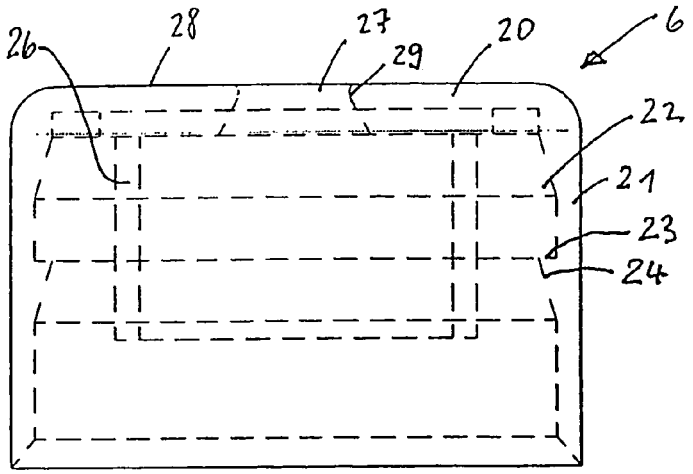
FIGS. 4A and 4B show a side view and a top view of the container cap according to FIG. 1.
Figure 4B:
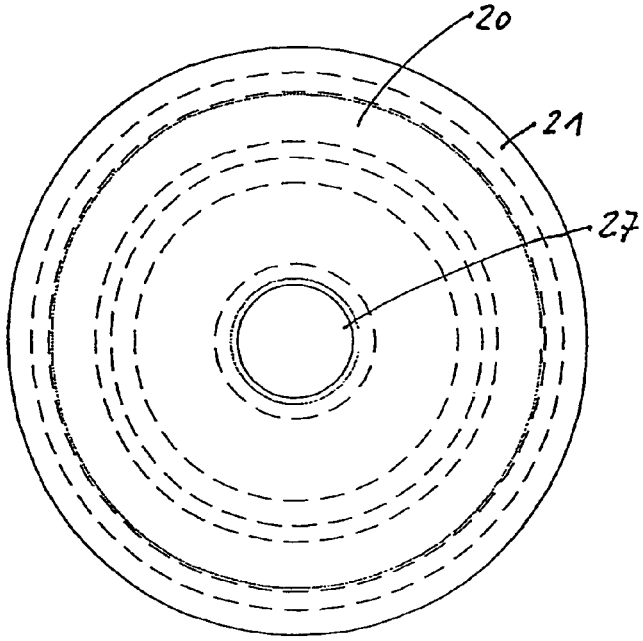

The main components of the sterile valve according to the invention are a valve seat 1, an elastic sealing body 2 and, preferably, a sterilization element 3 which are arranged in the neck 4 of a container 5 in a way described further below. Moreover, a container cap 6 which is configured in a special way cooperates with the components of the sterile valve.

The valve seat 1 consists of a planar base plate 7 with an adjoining cylindrical circumferential wall 8 which tightly rests in the installed position on the inner wall of the container neck 4 and ends in an outwardly oriented annular collar 9 that rests on the upper edge of the container neck 4.

The base plate 7 includes four through holes 10 that are shaped in the form of a circular arc and are evenly distributed in circumferential direction.

In the center of the circular base plate 7, a pin-like projection 11 is formed that projects from the base plate 7 at a right angle and has a circular cylindrical shape which passes into an end section 12 which is shaped in the form of a truncated cone and projects beyond the annular shoulder 9.

Like the valve seat 1, the sealing element 2, which consists of an elastic plastic material, is also produced in one piece and includes a planar annular section 13 which on its radial inner circumferential edge passes into a sleeve-like section 14 whose central longitudinal axis extends in a direction perpendicular to the plane of the annular section 13. Starting from the annular section 13, the sleeve-like section 14 consists of a first circular cylindrical section 15, an adjoining central section 16 tapered conically upwards, and an end section 17 which has again a circular cylindrical shape on its outer contour. The end section 17 has a wall thickness continuously increasing towards its free end because its inner contour extends conically in alignment with that of section 16. The upper edge of the sleeve-like section is designated by reference numeral 18 while the upper edge of the projection 11 is provided with the reference numeral 19.

The closing cap 6 of the container 5 contains an upper end wall 20 and a circumferential wall 21 of a substantially circular cylindrical shape. A flat indentation 22 is formed on the inside of the circumferential wall 21 and ends on a radially inwardly oriented annular collar 23 which forms the upper side of an obliquely inwardly oriented surrounding nose 24. Said nose 24 grips below a surrounding outer projection 25 on the outside of the container neck 4 when the cap 6 is snapped onto the container neck 4.

Radially inside the circumferential wall 21, the bottom side of the upper end wall 20 of the cap 6 has formed thereon an annular projection 25 which has such an extension that in the installed position of the sterile valve and the cap 6 it presses the annular section 13 of the sealing body 2 firmly against the base plate 7 of the valve seat 1.

In the middle of the upper end wall 20 of the cap 6, a circular round exit opening 27 is provided for the flowable material received in the container. Viewed in cross section, the exit opening 27 is first slightly narrowed, starting from the upper side 28 of the cap 6, to increase more and more in width again after a cross-sectional rounding 29. Viewed from the upper side 28 of the cap 6, the edge contour of the exit opening 27 extends in longitudinal section first in arcuate fashion inwards and then outwards again, which is followed by a section which is oriented obliquely outwards. In the area of the smallest place, the exit opening 27 is smoothly rounded.

Figure 5A:
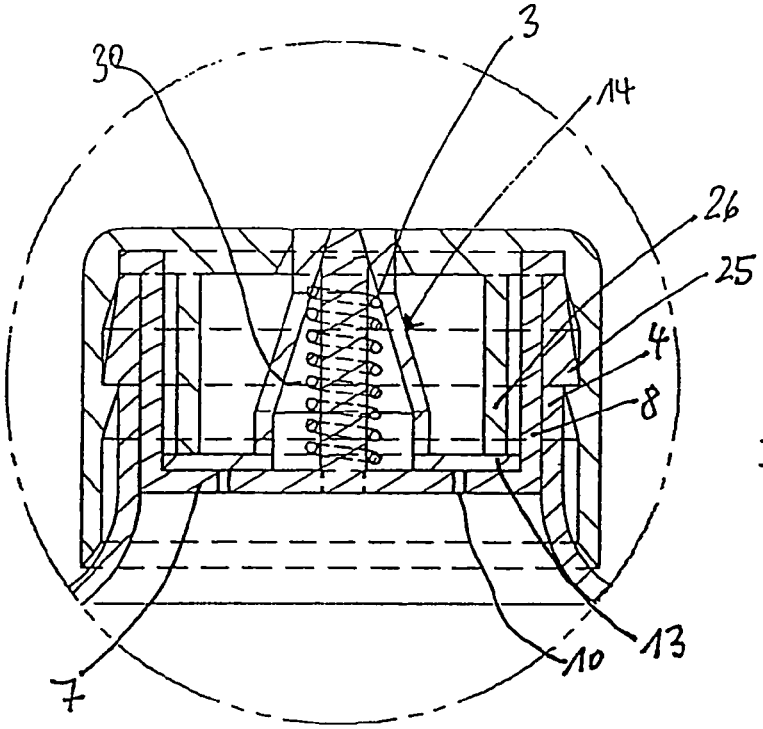
FIGS. 5A and 5B are longitudinal sections through the one-way valve of FIG. 1 as mounted on the container neck, in the closed and in the opened state.
Figure 5B:
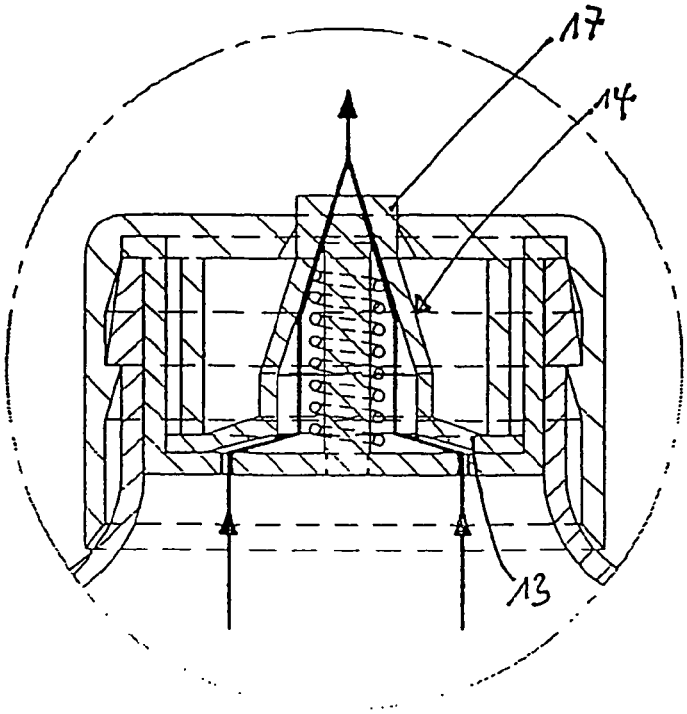

FIGS. 5A and 5B show that the sterilization element 3 which is provided with a silver coating and has the shape of a spiral screw or spiral spring surrounds the projection 11 of the valve seat 1 at a small distance. The cavity 30 which is defined by the sleeve-like section 14 of the sealing element 2 and the projection 11 and through which the flowable material flows while being discharged in doses is narrowed, viewed in cross section, in the manner of a wedge towards the upper end such that the sterilization element 3 touches the sealing element in the upper area. This is not the case in the lower area of the sealing element where the intermediate space between the sealing element and the projection has a considerable width.

In the installed position of the sterile valve, the upper side 19 of the projection 11 extends flush with the upper side 28 of the cap 6. This is also true for the upper side 18 of the sleeve-like section 14 when the sterile valve is closed, i.e. when the annular section 13 rests flat on the base plate 7. In the closed state, the upper end section 17 of the sleeve-like section 14 of the sealing element 2 completely fills the annular gap between the head end 12 of the projection 11 and the circumferential wall of the exit opening 27.

When pressurized flowable material is pressed through the through holes 10 in the base plate 7 of the valve seat 1, the radially inner area of the annular section 13 of the sealing element 2 is lifted upwards, as shown in FIG. 5B, which has the effect that the whole sleeve-like section 14 moves upwards and the end section 17 of the sealing element which has so far provided for the sealing action exits upwards out of the exit opening 27. This movement is a smooth one due to the conically tapered outside of the end section 12 of the projection 11 and the rounded perforated wall.

When pressure is no longer exerted on the contents of the container, the sealing element 2 will automatically return into its initial position due to the elasticity of its material. The restoring force can here be defined by selecting a suitable elastic material and suitable dimensions especially for the wall thickness of the annular section 13.

The invention claimed is:

1. A one-way valve for discharging a flowable material from a container of a reducible volume, comprising:

an independent valve seat which is positioned in an opening defined by a neck of the container and comprises a base body which rests on an inner wall of the container neck and contains at least one through hole, and a projection having an end section, said projection extending axially from said base body;

an elastic seal which comprises a flexible annular section seated on said at least one through hole, and a sleeve-like section extending axially from said annular section and having an end section, said sleeve-like section surrounding the projection at a radial distance with the exception of its end section; and a non-removable cap configured to enclose said valve seat and said seal and defining an exit opening, wherein when the one-way valve is in a closed state, said flexible annular section is seated on said at least one through hole to seal said at least one through hole and prevent contaminants from entering the container through said at least one through hole and said end sections of said projection and said seal are positioned in said exit opening and are in engagement to seal said exit opening, and when the one-way valve is in an open state, a portion of said flexible annular section flexes upwardly away from said at least one through hole and said end section of said seal moves upwardly out of said exit opening to dis-engage said end section of said seal from said end section of said projection to allow the material to pass through said at least one through hole and be discharged from said exit opening, said sleeve-like section of said elastic seal forming a seal between said projection and a space under said cap for preventing the material from remaining in said space after it is discharged from said exit opening.

2. The one-way valve according to claim 1, wherein a sterilization means is arranged in the flow path of the flowable material.

3. The one-way valve according to claim 2, wherein the sterilization means is a spiral-like sterilization element which surrounds the projection.

4. The one-way valve according to claim 2, wherein the sterilization means is formed by coating at least parts of the valve seat and/or the seal with metals having an oligodynamic action or with substances having a bactericidal action.

5. The one-way valve according to claim 1, wherein the base body contains a plurality of through holes radially outside of the projection.

6. The one-way valve according to claim 5, wherein the sterilization element in the closed state of the valve is, on the upper end portion, in contact with both the projection and the sleeve-like section of the seal.

7. The one-way valve according to claim 5, wherein the sterilization element consists of silver or of another metal having an oligodynamic action, or of a substance having a bactericidal action, or is coated therewith.

8. The one-way valve according to claim 1, wherein the projection of the valve seat has a circular cylindrical shape and said end section has a tapering, preferably conically beveled shape.

9. The one-way valve according to claim 1, wherein the projection of the valve seat has an arcuate contour in longitudinal section.

10. The one-way valve according to claim 1, wherein an upper edge of the projection is arranged inside the container opening.

11. The one-way valve according to claim 1, wherein the annular section of the seal has a planar shape and is held by an annular projection of the cap radially outside of the at least one through hole in contact with the base plate of the valve seat.

12. The one-way valve according to claim 1, wherein the sleeve-like section of the seal in longitudinal section, starting from the annular section, is configured to be first cylindrical, then conical and then cylindrical again on its outside.

13. The one-way valve according to claim 1, wherein the sleeve-like section in longitudinal section has an arcuate contour.

14. The one-way valve according to claim 1, wherein the end section of the sleeve-like section has an inner contour corresponding to the circumferential surface of the end section of the projection and rests within the container opening so that the annular gap between the end section of the projection of the valve seat and the inner wall of the container opening is tightly closed in the closed state of the one-way valve.

15. The one-way valve according to claim 1, wherein the upper edge of the sleeve-like section of the seal is in alignment with the upper side of the cap in the closed state of the valve.

16. A one-way valve for discharging a flowable material from a container of a reducible volume, comprising:

a non-removable cap seated on a neck of the container and defining an exit opening that allows the flowable material to exit the container;

a valve seat which is positioned in an opening defined by the container neck and includes a base body including a planar base plate having at least one through hole and a circumferential wall including an externally surrounding shoulder that engages an edge of the container neck, and a projection which extends in an axial direction of the container neck towards the exit opening;

an elastic seal including a flexible annular section seated on said valve seat and said at least one through hole for preventing contaminants from entering the container through said at least one through hole and a sleeve-like section extending axially from said annular section and surrounding the projection at a radial distance with the exception of its end section, which in the closed state of the one-way valve, is positioned in the exit opening and engaged with the end section of the projection to seal the exit opening for preventing the flowable material from passing through said exit opening, said sleeve-like section forming a seal between said projection and a space under said cap for preventing the material from remaining in said space after it is discharged from said exit opening; and wherein the annular section of the seal has a planar shape and includes a portion that flexes upwardly when the one-way valve is in an open state and another portion that is held by an annular projection of said cap radially outside of said at least one through hole in contact with said base plate of said valve seat.

* * * * *